US005260184A

United States Patent [19]

Marsden et al.

[11] Patent Number: 5,260,184

[45] Date of Patent: Nov. 9, 1993

[54] METHOD OF FORMING A PHOTOGRAPHIC COLOR IMAGE

[75] Inventors: Peter D. Marsden, North Harrow; Peter J. Twist, Great Missenden, both of Great Britain

[73] Assignee: Eastman Kodak Company, Rochester, N.Y.

[21] Appl. No.: 839,760

[22] PCT Filed: Apr. 24, 1990

[86] PCT No.: PCT/EP90/00726

§ 371 Date: Apr. 7, 1992

§ 102(e) Date: Apr. 7, 1992

[87] PCT Pub. No.: WO90/13061

PCT Pub. Date: Nov. 1, 1990

[30] Foreign Application Priority Data

Apr. 26, 1989 [GB] United Kingdom ..... 8909580

[51] Int. Cl.[5] ..... G03C 7/31

[52] U.S. Cl. ..... 430/398; 430/361; 430/399; 430/414; 430/477

[58] Field of Search ..... 430/361, 398, 399, 414, 430/477, 943

[56] References Cited

U.S. PATENT DOCUMENTS

| | | | |
|---|---|---|---|
| 3,869,383 | 3/1975 | Shimamura et al. | 430/398 |
| 3,982,932 | 9/1976 | Korosi | 430/398 |
| 4,040,834 | 8/1977 | Iwano et al. | 430/398 |
| 4,529,687 | 7/1985 | Hirai et al. | 430/373 |
| 4,859,575 | 8/1989 | Kurematsu et al. | 430/398 |

FOREIGN PATENT DOCUMENTS

| | | |
|---|---|---|
| 2647930 | 5/1977 | Fed. Rep. of Germany . |
| 2059090 | 4/1981 | United Kingdom . |
| 8001962 | 9/1980 | World Int. Prop. O. . |

*Primary Examiner*—Hoa Van Le

*Attorney, Agent, or Firm*—Nixon, Hargrave, Devans & Doyle

[57] ABSTRACT

A method of forming a dye image in a photographic silver halide element containing a dye-providing compound and having in a layer thereof an imagewise distribution of catalytic silver which comprises the step of treating the material with a redox amplifying solution comprising a reducing agent and a redox amplification oxidant characterized in that the redox amplification oxidant is removed from the solution after use and the so-treated solution is re-used after the addition of fresh redox amplification oxidant.

12 Claims, 10 Drawing Sheets a 5gle SODIUM METABISULPHITE
b PtO2
c Ag/ALUMINA
d MnO2
e Pd/ALUMINA
f Pd BLACK
g Rh/ALUMINA
h Pd/ALUMINA
0.5gle of solid catalyst
[H2O2] ml/L
5.5
5.0
4.5
4.0
3.5
3.0
2.5
2.0
1.5
1.0
0.5
0.0
0
5
10
15
20
25
30
35
40
TIME (MIN)
a
b
c
d
e
f
g
h

METHOD OF FORMING A PHOTOGRAPHIC COLOR IMAGE

This invention relates to a method of forming a photographic colour image and in particular, to a method of forming such an image by a redox amplification process.

Redox amplification processes have been described, for example in British Specification Nos. 1,268,126, 1,399,481, 1,403,418 and 1,560,572. In such processes colour materials are developed to produce a silver image (which may contain only small amounts of silver) and then treated with a redox amplifying solution to form a dye image. The redox amplifying solution contains a reducing agent, for example a colour developing agent, and an oxidising agent which is more powerful than silver halide and which will oxidise the colour developing agent in the presence of the silver image which acts as a catalyst. Oxidised colour developer reacts with a colour coupler (usually contained in the photographic material) to form image dye. The amount of dye formed depends on the time of treatment or the availability of colour coupler rather than the amount of silver in the image as is the case in conventional colour development processes. Examples of suitable oxidising agents include peroxy compounds including hydrogen peroxide, cobalt (III) complexes including cobalt hexammine complexes, and periodates. Mixtures of such compounds can also be used.

Since the amplifying solution contains both an oxidising agent and a reducing agent it is inherently unstable. The best reproducibility for such a process is obtained by using a "one shot" system, where the oxidant is added to the developer and the solution mixed and used immediately (or after a short built in delay) and then discarded. This leads to the maximum solution usage possible with maximum effluent, and a processor has to be designed which uses small volumes of solution (a major difficulty) in order to minimize the effluent. As a result chemical costs are a maximum and the whole system is unattractive especially for a minilab environment where minimum effluent is required. It is believed that it is this that has inhibited commercial use of this process.

The present invention provides a method by which amplification may be achieved while overcoming the disadvantages of unstable processing solutions.

According to the present invention there is provided a method of forming a dye image in a photographic silver halide element containing a dye-providing compound and having in a layer thereof an imagewise distribution of catalytic silver which comprises the step of treating the material with a redox amplifying solution comprising a reducing agent and a redox amplification oxidant characterised in that the redox amplification oxidant is removed from the solution after use and the so-treated solution is re-used after the addition of fresh redox amplification oxidant.

Figure 1:
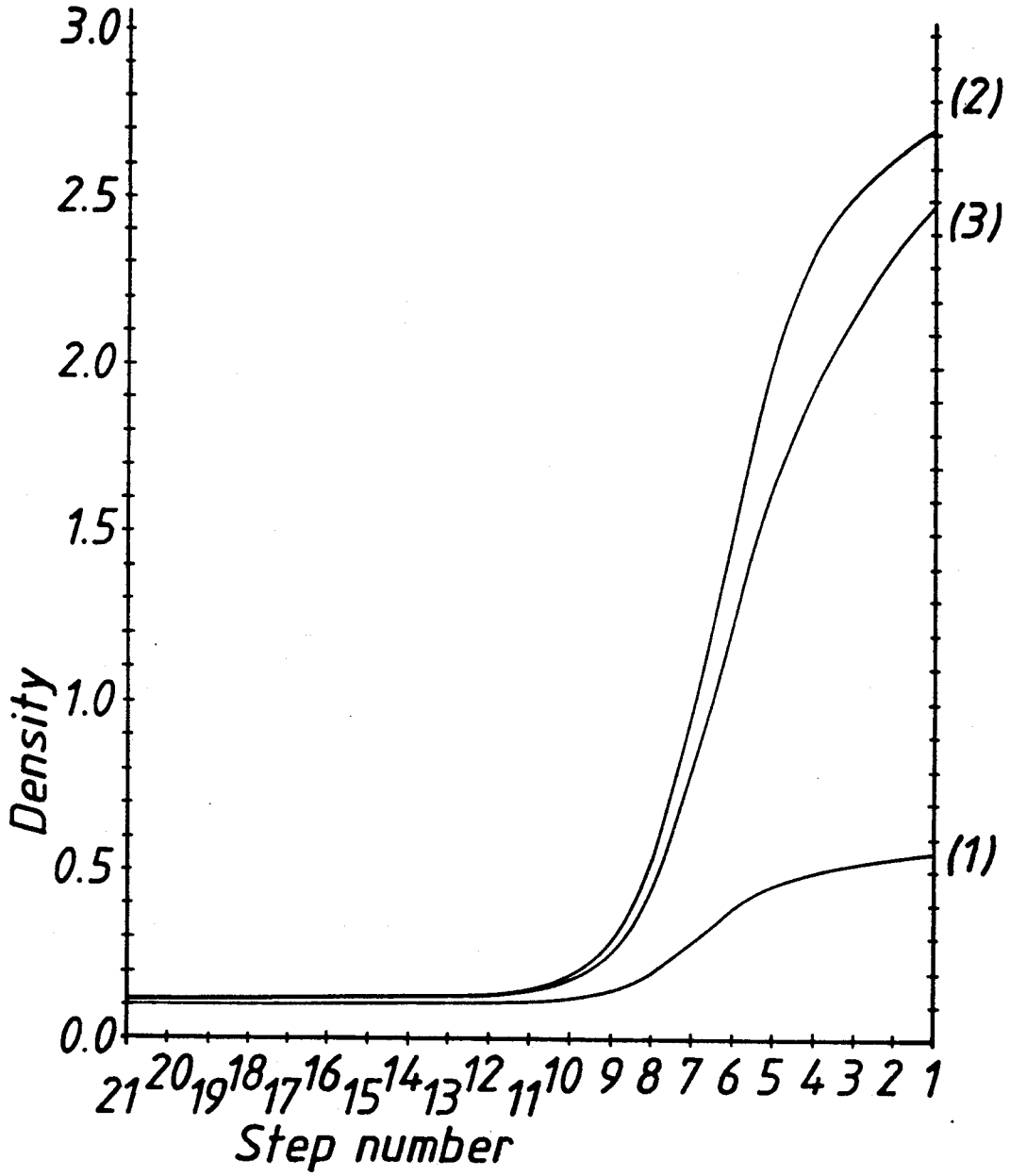
FIG. 1 is a plot of the sensitometries of each of strips (1), (2), and (3), which are described in detail in Example 1, below.

The dye-providing compound may be, for example, a dye developer, a redox dye releaser or a coupler capable of reacting with oxidised colour developer to form an image dye with or without the concommitant release of a photographically useful group. They may be incorporated into the photographic material by known means.

The reducing agent may, for example, be a colour developing agent, a black-and-white developing agent (or electron transfer agent) or an image modifier, interlayer scavenger, preservative or stain reducer, e.g. a sulphite, hydroxylamine or a substituted hydroxylamine. If an electron transfer agent is used, its oxidised form may be employed to oxidise a redox dye releaser which, in turn, will release a dye. If the reducing agent is a sulphite or hydroxylamine it will be present for any of the reasons noted above but will not take part in the image-forming process; its presence will, however, modify the stability of the solution. In such a system the reducing agent involved in the colour forming reaction need not be in the redox amplification solution but could be incorporated in the photographic material or applied from a separate bath.

In a preferred form of the present invention the reducing agent is a colour developing agent. Preferred colour developing agents are phenylene diamines. Especially preferred developing agents are 4-amino-3-methyl-N,N-diethylaniline hydrochloride, 4-amino-3-methyl-N-ethyl-N-$\beta$(methanesulphonamido)ethylaniline sulphate hydrate, 4-amino-3-methyl-N-ethyl-N-$\beta$(methanesulphonamido)ethyl-N,N-diethylaniline hydrochloride and 4-amino-N-ethyl-N-(2-methoxyethyl)-m-toluidine di-p-toluene sulphonate.

The invention has the following advantages:

(a) The treated used solution is stable and contains a known amount of oxidant (ideally zero). Consequently it can be kept for long periods in the stable condition and then reused by adding the required amount of oxidant and replenishing in the normal way (i.e. taking account of the amount of material that has been processed through the solution).

(b) Processor design would become simpler because larger volumes of solution could be used, kept and regenerated compared to a processor designed for one-shot operation.

(c) Effluent volume could be reduced to low levels.

The redox amplification solution will, in a preferred embodiment contain a colour developing agent and the silver halide material will contain a colour coupler. In an alternative embodiment the redox amplification solution will contain an electron transfer agent as reducing agent and the silver halide material will contain a redox dye-releasing compound.

The redox amplification oxidant maybe a peroxide, a cobalt (III) complex or a periodate, and is preferably hydrogen peroxide the source of which may be an aqueous solution of hydrogen peroxide or a compound capable of releasing it. The following description concerns hydrogen peroxide, but it is believed that methods of removing other oxidants could be devised.

A number of ways of removing hydrogen peroxide from amplifier solutions will now be described.

(1) Electrolytic reduction at a cathode:

$$2H^+ + 2e^- + H_2O_2 \rightarrow 2\ H_2O$$

with or without the addition of extra sulphite for added protection. One advantage is that non-oxidised developer is unaffected and oxidised developer may even be reduced back to its non-oxidised form at the cathode. The type of cathode may be very important and an acceptable anodic reaction would have to be chosen or the anode would have to be separated via a semi-permeable or anionic membrane. Migration of the $HO_2^-$ ion from the cathode would also help. Preferred electrode materials are titanium, platinum, platinum-rhodium, platinum coated titanium and silver. The electrodes may be rough or smooth and may be coated with manganese dioxide.

(2) Certain compounds (scavengers) may be preferentially oxidised (rather than colour developer) by $H_2O_2$ and so could be used sacrificially to remove the peroxide. A redox indicator dye may serve to show when enough reducing compound has been added. Examples of such compounds are hydroquinones, ballasted hydroquinones, hydrazines, aldehydes and compounds capable of tautomerising to give an enediol form, for example, ascorbic acid, reductone, methyl reductinic acid, dihydroxy acetone, 2,4-dihydroxy-4-methyl-1-piperidinocyclopenten-3-one (piperidino hexose reductone), catechol, ascorbyl palmitate and chromanols. Inorganic scavengers may be dithionites or phosphites. A particularly useful class of inorganic scavengers comprises water soluble or water insoluble sulphites and metabisulphites, e.g. sodium metabisulphite. Such scavengers may be added as solids or solutions and have the advantages of speed, inexpensiveness and do not cause loss of colour developing agent. Alternatively the scavenger could be coated in a layer of the photographic material being processed, e.g. as a top layer on the back of the material.

(3) Mordanted oxidisable dye. If this were in a cartridge with a window some indication of the state of the cartridge could be obtained and so it could be replaced when necessary.

(4) Catalytic decomposition and oxygen removal. Catalysts are numerous, the main criterion being small particle size, for example Mn, Ni, Pt, Ag, Pd Glass, Fe, manganous salts, manganous hydroxide, $MnO_2$, compounds which provide manganous hydroxide or $MnO_2$, catalase, black magnetic iron oxide ($Fe_3O_4$), ferrous salts, black copper oxide and cupric salts. It would be most advantageous if the catalytic surface could aid in "fixing" the oxygen e.g. $SO_3^= + O \rightarrow SO_4^=$; sulphite being supplied from solution. Alternatively metal + O→ metal oxide. The catalytic activity may be regenerated electrolytically by cathodic reduction. The preferred methods use manganese dioxide, catalase, palladium black, Adams platinum oxide catalyst, ground pumice and cathodic electrolysis. Alternatively the catalyst could be coated in a layer of the photographic material being processed, e.g. as a top layer on the back of the material.

(5) Combined oxygen permeable membrane and catalyst. Decompose the peroxide at the membrane surface and allow oxygen to diffuse into an air space (c.f. removal of $NH_3$ from developers with yeast bags).

(6) Vacuum should favour decomposition because of the formation of a gas i.e. by subjecting a thin film of the solution to a vacuum it may be possible to pull off the oxygen from a catalytic surface.

(7) Decomposition of hydrogen peroxide in the presence of a catalyst is accelerated by ultrasonic agitation. Cavitation may favour such decomposition.

(8) Dialysis, through semipermeable membranes, of the used solution to remove the hydrogen peroxide using a closed loop for the extraction solution. The process should be arranged so that the maximum concentration difference in hydrogen peroxide will exist across the membrane and depends on the non-passage (or reduced passage) of reducing agent through the membrane. Any chloride ion released in the amplification process would also be extracted and this could be an added advantage.

(9) The used amplification solution is iled under reduced pressure. The vapour in equilibrium with the solution will be a mixture of $H_2O$ and $H_2O_2$. If this vapour is drawn off and passed over a catalyst the hydrogen peroxide may then be decomposed to oxygen and water. The water could be condensed and returned to the main solution and the oxygen would be exhausted and discarded via the vacuum pump.

The colour photographic material to be processed may be of any type but will preferably contain low amounts of silver halide. Preferred silver halide coverages are in the range 10–200 mg/m$^2$ (as silver). The material may comprise the emulsions, sensitisers, couplers, supports, layers, additives, etc. described in Research Disclosure, December 1978, Item 17643, published by Kenneth Mason Publications Ltd, Dudley Annex, 12a North Street, Emsworth, Hants P010 7DQ, U.K.

In a preferred embodiment the photographic material comprises a resin-coated paper support and the emulsion layers comprise more than 80%, preferably more than 90% silver chloride and are more preferably composed of substantially pure silver chloride. Preferably the amplification solution contains hydrogen peroxide and a colour developing agent.

The photographic materials can be single colour materials or multicolour materials. Multicolour materials contain dye image-forming units sensitive to each of the three primary regions of the spectrum. Each unit can be comprised of a single emulsion layer or of multiple emulsion layers sensitive to a given region of the spectrum. The layers of the materials, including the layers of the image-forming units, can be arranged in various orders as known in the art.

A typical multicolour photographic material comprises a support bearing a yellow dye image-forming unit comprised of at least one blue-sensitive silver halide emulsion layer having associated therewith at least one yellow dye-forming coupler, and magenta and cyan dye image-forming units comprising at least one green- or red-sensitive silver halide emulsion layer having associated therewith at least one magenta or cyan dye-forming coupler respectively. The material can contain additional layers, such as filter layers.

Normally in the commercial environment, processing of photographic materials is performed by machine and increasingly by small machines of the minilab type. In the present case it is desirable for the tank in which redox amplification takes place to have a small as possible volume to minimise chemical costs. The oxidant removal may be performed continuously or only when the machine is idle. It might, for example, be desirable to initiate oxidant removal only if the machine has been idle for ten minutes.

In either case it may be that the destruction of oxidant also removes other wanted components such as colour developer, sulphite ions or hydroxylamine compounds. To compensate for this, these components in addition to the normal replenisher will need to be added to the amplification bath.

Figure 7:
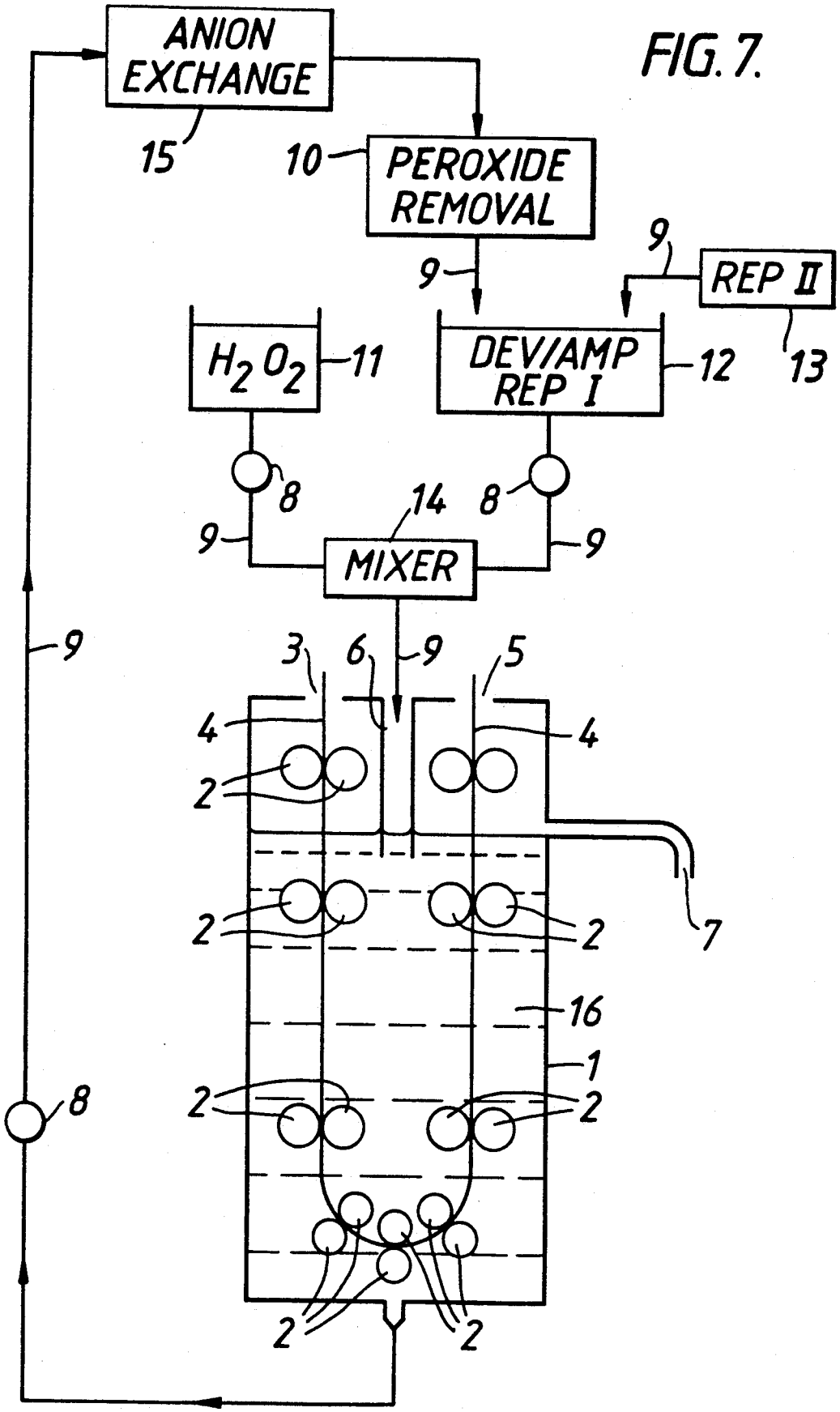
FIG. 7 is a schematic of a redox amplification system in accordance with the invention. The system is described in detail in several later paragraphs.

A particular arrangement is illustrated in FIG. 7 of the accompanying drawings in which there is schematically shown the amplification tank (1) of a processing machine provided with material drive rollers (2), inlet (3) and outlet means (5) for the material to be processed. The machine has inlet means for the replenishment of processing solution (6) and overflow means (7). Associated with the tank are pumps (8), pipes (9), peroxide removal cartridge (10), aqueous hydrogen peroxide tank (11), replenisher tank (12), additional replenisher tank (13) and mixer (14) and anion exchange resin cartridge (15) to remove unwanted chloride and bromide ions. Instead of the peroxide removal cartridge the solution could be fed to a tank where the removal takes place. Locating the anion exchange cartridge after peroxide removal ensures that there is no interaction with hydrogen peroxide, as it has been removed. Alternatively the anion exchange cartridge could be located before peroxide removal. In such a case removal of chloride and bromide ions would be advantageous if silver was used as the peroxide decomposition catalyst.

In use, the amplification solution (16) may be pumped to the treatment and replenishment stations continuously or intermittently as desired, e.g. when the machine has been idle for a specified time period. The amplifier solution is pumped to the cartridge (10) containing, for example, a catalyst for the decomposition of hydrogen peroxide. The treated solution is then fed to the replenisher tank (12). In one mode of operation this would only happen when the machine was idle and in this case the supply of oxidant and replenisher to the mixer (14) would be shut off. During operation the amplifier solution would be replenished by feeding the required amounts of oxidant and replenisher to the tank via the mixer. Alternatively, for continuous oxidant destruction a regime of oxidant destruction and replishment would be established.

If oxidant destruction is also causing some loss of other oxidisable components, their loss could be compensated for by feeding in a second replenisher from tank (13).

In an alternative method the cartridge (10) could be dispensed with by circulating through tank (1) a coated material containing, say, a catalyst for the decomposition of hydrogen peroxide. The peroxide destruction would then take place inside the tank itself. Recirculation and replenishment could be achieved as described above except that the cartridge (10) would be absent.

The following examples are included for a better understanding of the invention.

In the examples below, in the case of the removal of hydrogen peroxide by catalysts, the developer/amplifier solution containing the hydrogen peroxide was mixed with a small amount of the catalyst in a round bottomed flask while nitrogen was passed through the solution and the pressure reduced in order to sweep away any oxygen formed. It is not known whether these attempts to remove oxygen by sweeping the solution with nitrogen under reduced pressure are important. The length of treatment and the amount of catalyst required have also not been investigated.

In the case of electrolysis a simple H cell was used with a remote anode such that cathode and anode compartments could be isolated from each other with a tap and the catholyte examined.

The success of the method of removal can be judged by running an amplification process using the solution in question. If the peroxide has been removed no amplification will occur. An additional check can also be made by testing the solution with lead sulphide test paper when a white spot indicates the presence of peroxide.

EXAMPLE 1

The following solutions were made up:

| | |
|---|---|
| Developer/amplifier Solution A | |
| $Na_2SO_3$ | 1.0 g |
| $Na_2CO_3$ | 20.0 g |
| CD3 | 5.0 g |
| KBr | 0.001 g |
| $Na_2EDTA.2H_2O$ | 0.1 g |
| Distilled Water to | 960 ml |
| Hydrogen Peroxide Solution B | |
| Hydrogen Peroxide 100 VOL | 8.0 ml |
| Distilled Water to | 20.0 ml |
| Antifoggant Solution C | |
| Acetamido PMT | 0.0436 g |
| $Na_2CO_3$ | 0.010 g |
| Distilled Water to | 40.0 ml |
| Antistain Solution D | |
| Ascorbic Acid | 0.436 g |
| Distilled Water to | 40.0 ml |

MULTILAYER COATING

A colour paper of similar construction to currently available silver chloride paper was prepared. All the emulsions were substantially pure silver chloride and the silver coverage in the three image layers were: yellow 49.5 mg/m$^2$ magenta 21.5 mg/m$^2$, cyan 19.4 mg/m$^2$ giving a total silver coverage of 90.4 mg/m$^2$.

The following strips were processed

STRIP 1—fresh solution, no $H_2O_2$ present (control)

A fresh solution was prepared of 96 ml of the developer/amplifier solution A, 1.0 ml antifoggant solution C, and 0.25 ml antistain solution D. An exposed strip (1) of the multilayer coating with reduced silver coverage (exposed to a four colour wedge to give Cyan, Magenta, Yellow and neutral wedges) was then processed in the solution for 60 secs at 350° C. The full process is indicated below. Low densities were observed due to normal colour development without redox amplification. The sensitometry for strip (1) is shown in FIG. 1.

| PROCESS | |
|---|---|
| Develop/amplify | 60 secs |
| Stop 2% acetic acid | 30 secs |
| Wash | 30 secs |
| RA4 Bleach Fix | 30 secs |
| Wash | 120 secs |
| Temperature | 35° C. |
| Processing method | H11 DRUM |

STRIP 2—fresh solution, $H_2O_2$ present (control) developer/amplifier solution A and 0.5 ml peroxide resolution B. After adding 1.0 ml antifoggant solution C and 0.25 ml antistain solution D exposed strip (2) was immediately processed as described above. Normal redox amplification observed. The sensitometry is shown in FIG. 1.

STRIP 3—Treated solution kept 1 hr with $H_2O_2$ present

In a 500 ml three necked RB flask fitted with a nitrogen bubbler and a water condenser was placed a premix of 96 ml of developer/amplifier solution A and 0.5 ml of peroxide solution B. A gradual flow of nitrogen was bubbled through the solution while it was pumped to a pressure of approximately 35 mm Hg and the temperature was maintained at 35° C. for 10 mins. The solution was removed, made up to volume and kept a further 50 mins at 18° C. 1.0 ml antifoggant solution C and 0.25 ml antistain solution D were added to the solution. An exposed strip (3) of the multilayer coating was processed in the solution for 60 secs at 35° C. as above. The sensitometry is shown in FIG. 1.

The comparison of the sensitometry of strips 1, 2 and 3 shown in FIG. 1 represents the effect of (a) having no $H_2O_2$ present and (b) the effect of keeping the peroxide solution (treated in the manner described) for 1 hr. In the latter case a loss of shoulder contrast together with a loss of speed was observed (cf the fresh peroxide control).

STRIP 4—solution containing $H_2O_2$ treated with $MnO_2$

Figure 2:
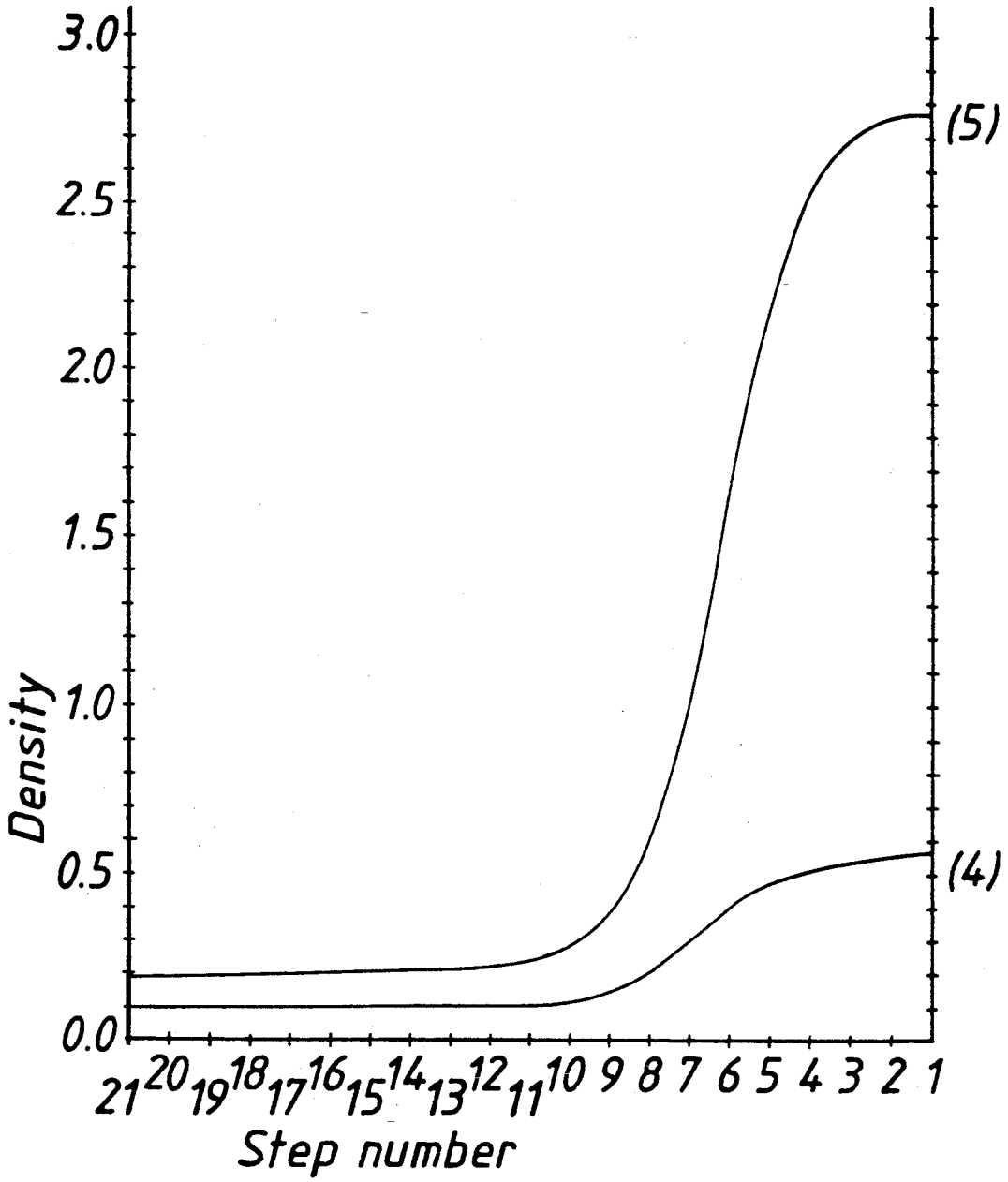
FIG. 2 is a plot of the sensitometries of strips (4) and (5), also described in detail in Example 1, below.

The solution and method used to prepare strip 3 was repeated only this time 0.15 g of black manganese dioxide was introduced into the flask before the mixture of developer/amplifier (96 ml solution A) and peroxide (0.5 ml solution B) was added. The solution was pumped under nitrogen for 10 mins at 35° C., filtered and made up to volume with water. 1.0 ml of the antifoggant solution C and 0.25 ml of the antistain solution D was added and a strip (4) was processed as above. Very low densities were obtained due to the removal of the peroxide. The sensitometry is shown in FIG. 2. Testing the solution with lead sulphide test paper indicated that only a very low level of hydrogen peroxide was present.

STRIP 5—addition of $H_2O_2$ as solution used for STRIP 4

While the solution was still on the processing drum 0.5 ml of the peroxide solution B was added and allowed to mix. A further strip (5) was then processed. The high densities were restored due to redox amplification. A comparison of the sensitometry of strips 4 and 5 is shown in FIG. 2.

Figure 3:
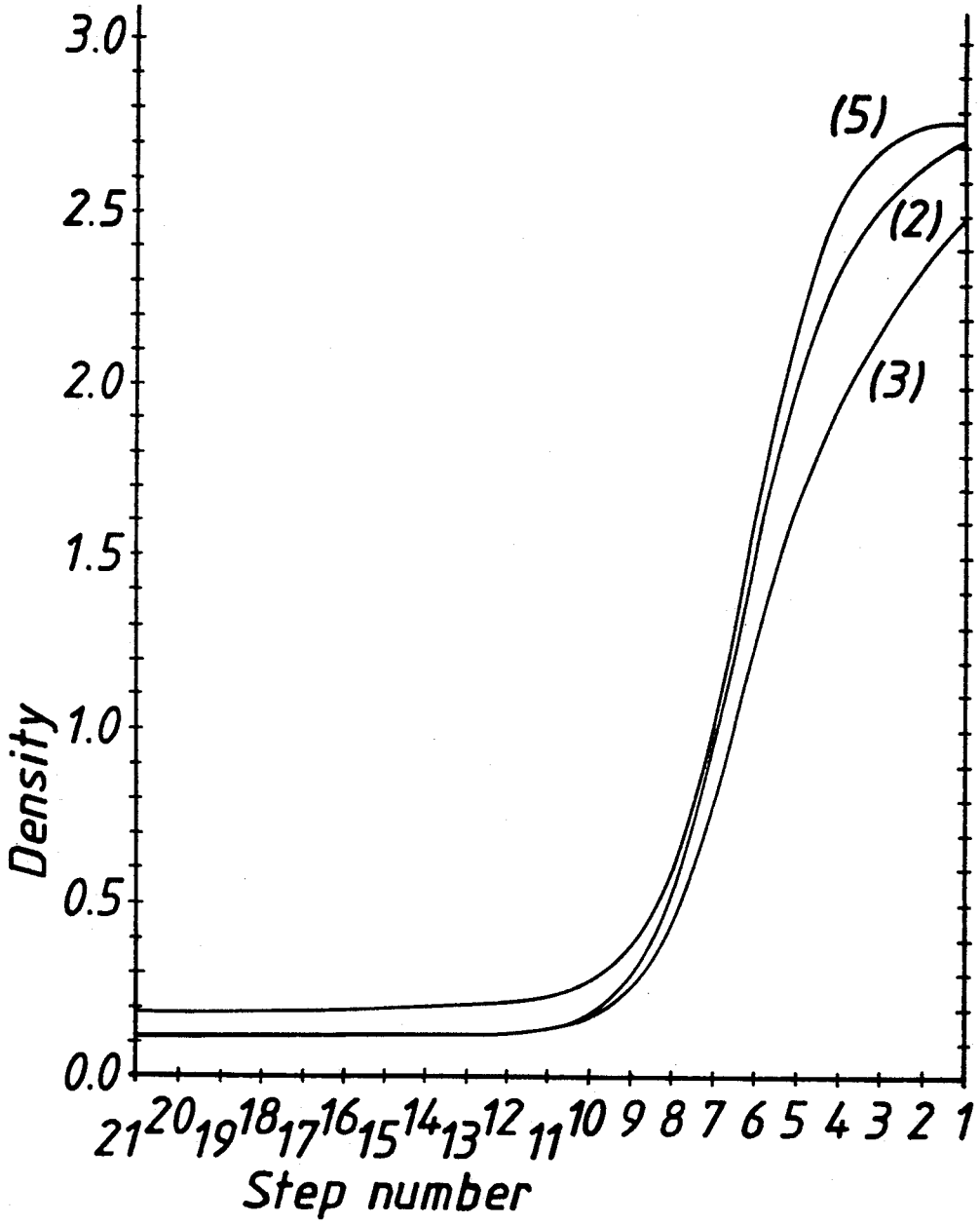
FIG. 3 is a plot comparing the sensitometries of strips (2), (3), and (5), which are described in detail in Example 1, below.

The results shown in FIGS. 1 and 2 indicate that hydrogen peroxide can be successfully removed from a working developer/amplifier solution. FIG. 3 shows a comparison of strip 2 (control with peroxide present), 3 (control kept 1 hr $H_2O_2$ present) and 5 (peroxide removed with $MnO_2$ and then $H_2O_2$ readded).

EXAMPLE 2

Figure 4:
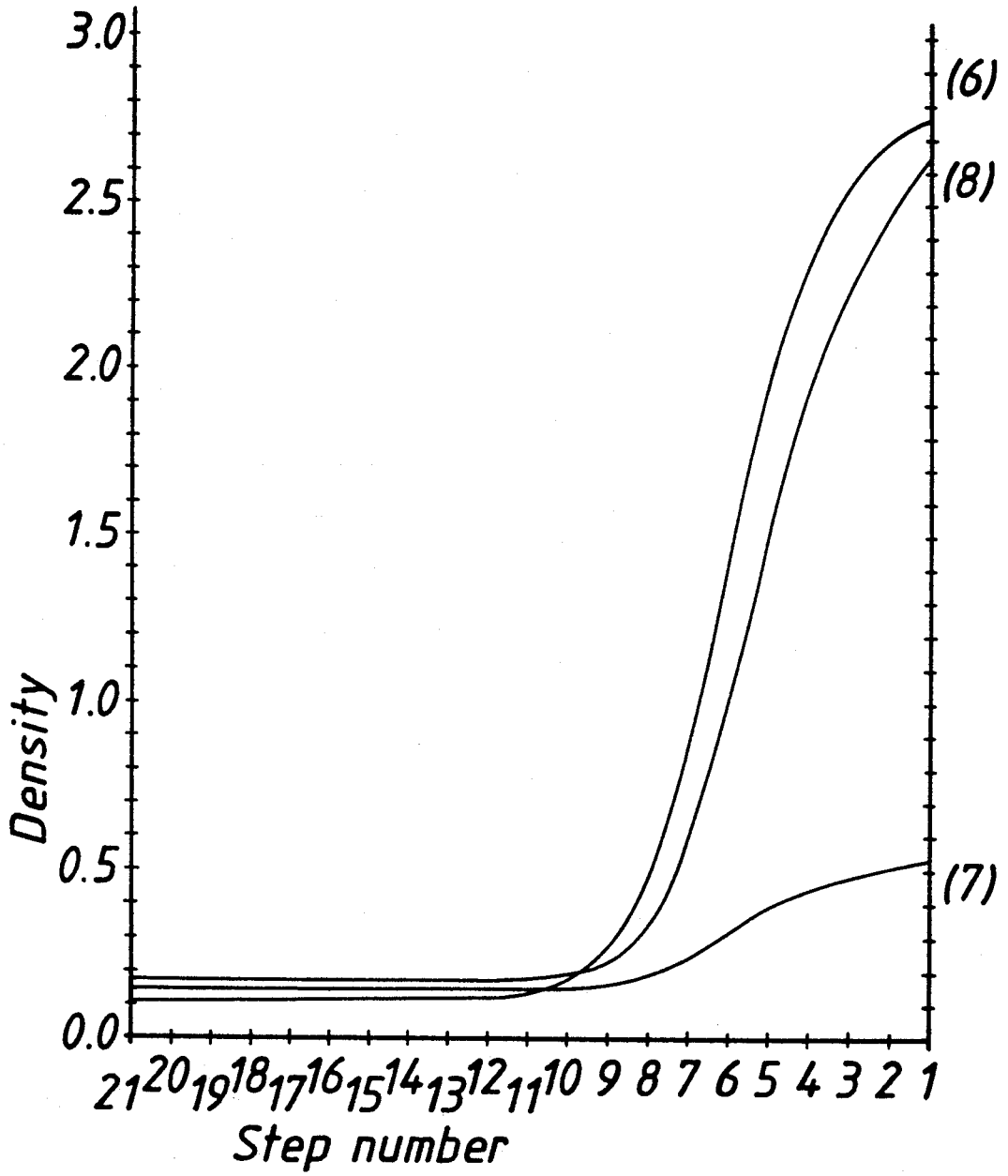
FIG. 4 is a plot of the sensitometries of strips (6), (7), and (8), which are described in detail in Example b 2, below.

(STRIPS 6–10)—The long term stability of solutions which have had peroxide removed STRIP 6—Fresh control A fresh control (strip 6) was repeated as described under Strip 2. High densities were observed showing the result of a normal Redox process. The sensitometry is shown in FIG. 4.

STRIP 7 effect of keeping the control solution 46 hrs with $H_2O_2$ 0 present

The method described under STRIP 3 was repeated only with the following differences:

a mixture of 192 ml developer/amplifier solution A was taken with 1.0 ml peroxide solution B. A gradual flow of nitrogen was bubbled through the solution while it it was pumped and the temperature was maintained at 18° C. for 20 mins. 96 ml of this solution was then placed in a 500 ml stoppered conical flask under nitrogen and left in a water bath at 35° C. for 46 hrs. During this time the solution had turned dark brown and formed a black precipitate. The solution was filtered, made up to volume. 1.0 ml antifoggant solution C, 0.25 ml antistain solution D was added and a strip (7) was processed as described above. This time the densities observed were low indicating the loss of peroxide and a general deterioration of the solution. The sensitometry is shown in FIG. 4.

STRIP 8—addition of $H_2O_2$ to solution used for strip 7.

While the solution used to process strip 7 was still on the drum processor 0.5 ml peroxide solution was added, allowed to mix and another strip (8) was processed. Appreciably higher densities were observed indicating that on leaving a developer/amplifier solution containing peroxide for 46 hrs at 35° C. the peroxide disappears of its own accord and that some photographic activity can then be restored by the re-addition of more peroxide. The sensitometry for strip 8 is shown in FIG. 4.

STRIP 9—Peroxide removal with $MnO_2$, and solution left 46 hrs

Figure 5:
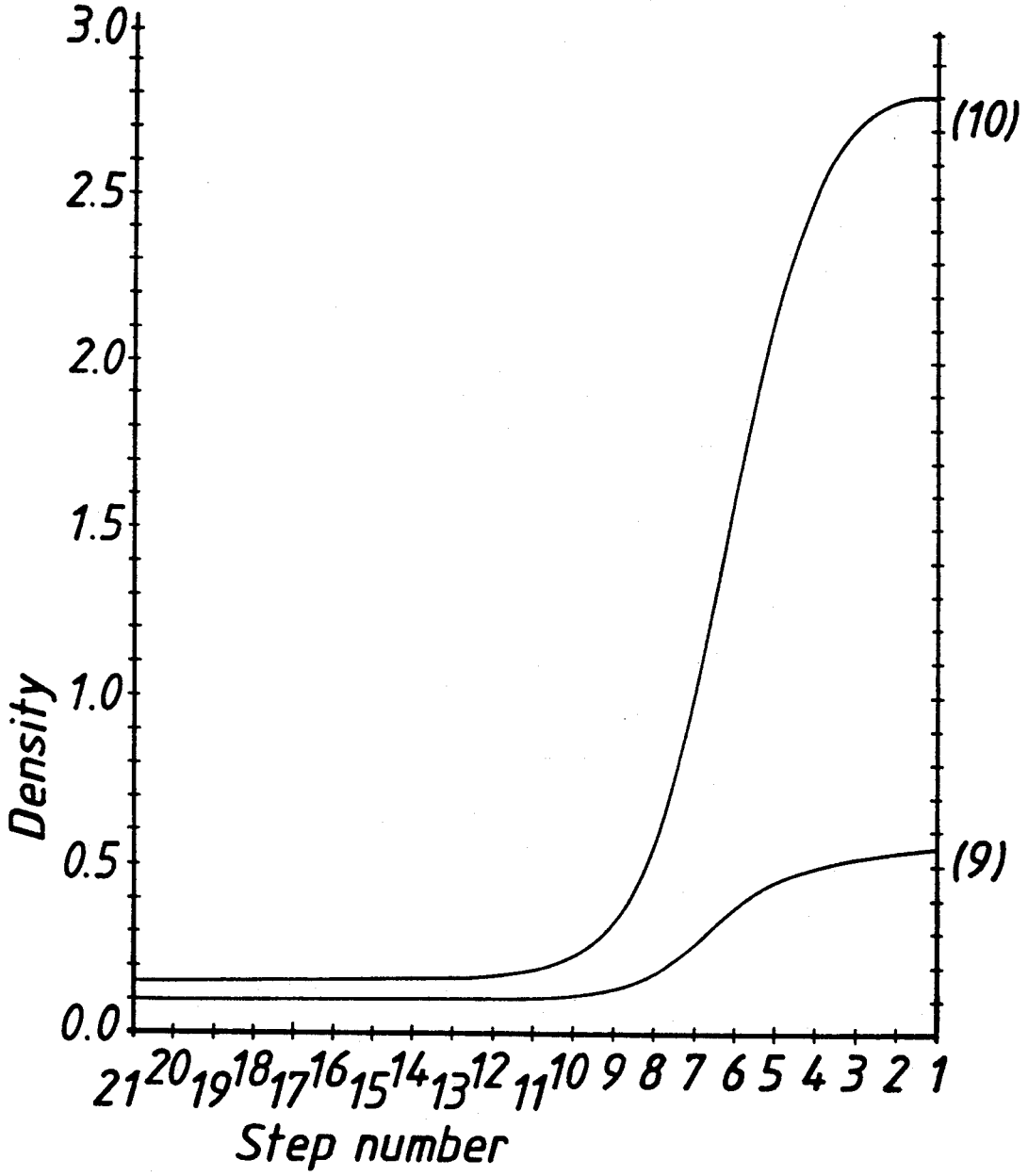
FIG. 5 is a plot of the sensitometries of strips (9) and (10), which are described in detail in Example 2, below.

The example shown under strip 7 was repeated only this time 0.3 g of black manganese dioxide was added to the flask at the start of the experiment. As before the solution was bubbled with nitrogen and pumped for 20 mins at 18° C. The solution was filtered and left under nitrogen for 46 hrs at 35° C. After this time the solution was a light brown colour and did not contain a precipitate. After the addition of the antifoggant and antistain solutions, a strip (9) was processed. Low densities were observed indicating the removal of the peroxide. The sensitometry is shown in FIG. 5.

While the solution used to process strip 9 was still on the drum processor 0.5 mi peroxide solution was added, allowed to mix and another strip was processed. High densities were observed (higher than for strip 8). The sensitometry for strip 10 is shown in FIG. 5.

Figure 6:
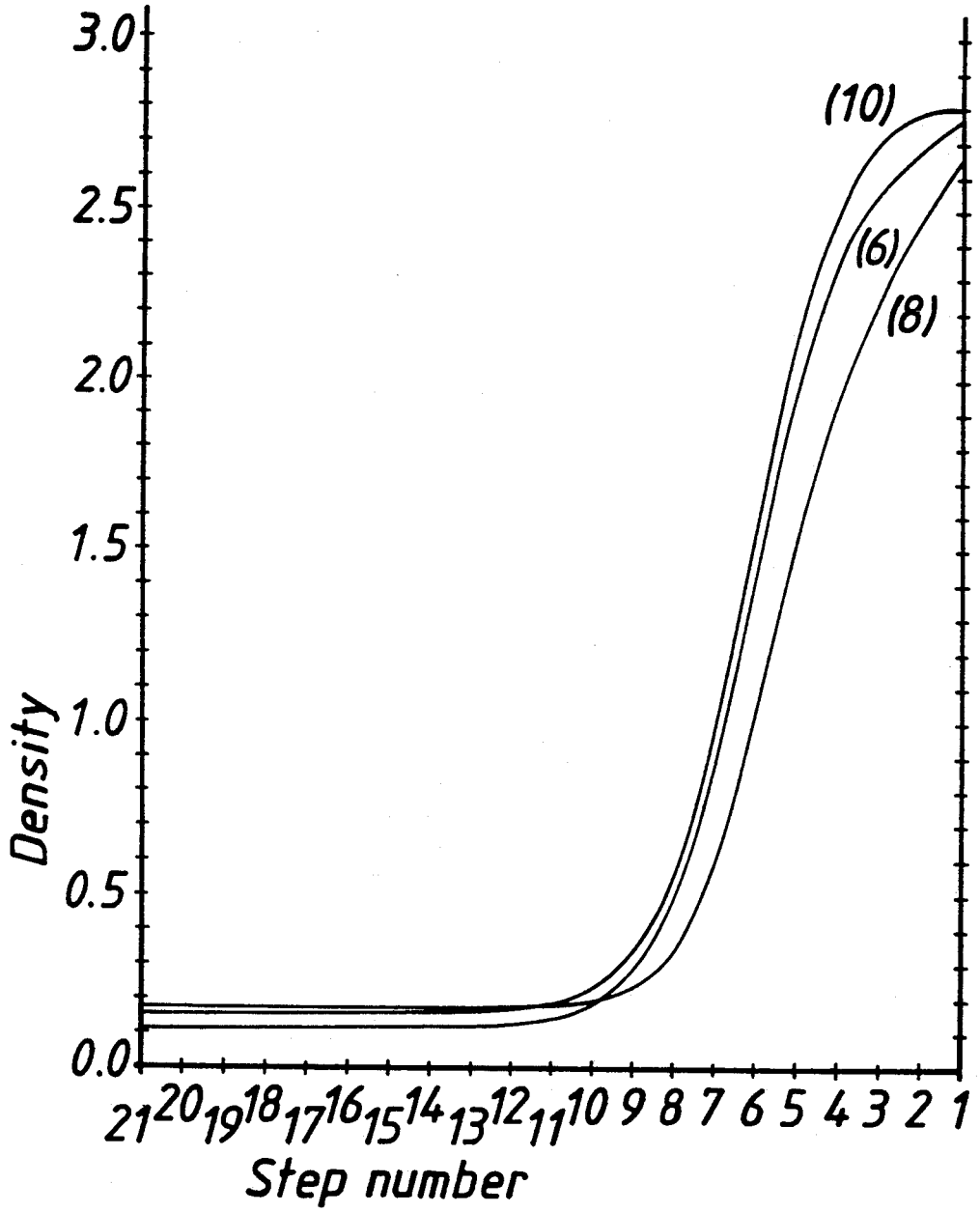
FIG. 6 is a plot comparing the sensitometries of strips (6), (8), and (8), which are described in detail in Example 2, below.

FIG. 6 shows a comparison of (a) a fresh redox process, (Strip 6), (b) the result when a redox solution containing peroxide is kept 46 hrs at 35° C. and is then rejuvenated by the addition by the addition of more peroxide, (Strip 8), and (c) the result when a solution containing peroxide is treated initially to remove the peroxide, kept 46 hrs at 35° C. and then rejuvenated by adding more peroxide (Strip 10). A higher density is observed for (c) indicating the advantage of removing the peroxide rapidly.

EXAMPLE 3

Figure 8:
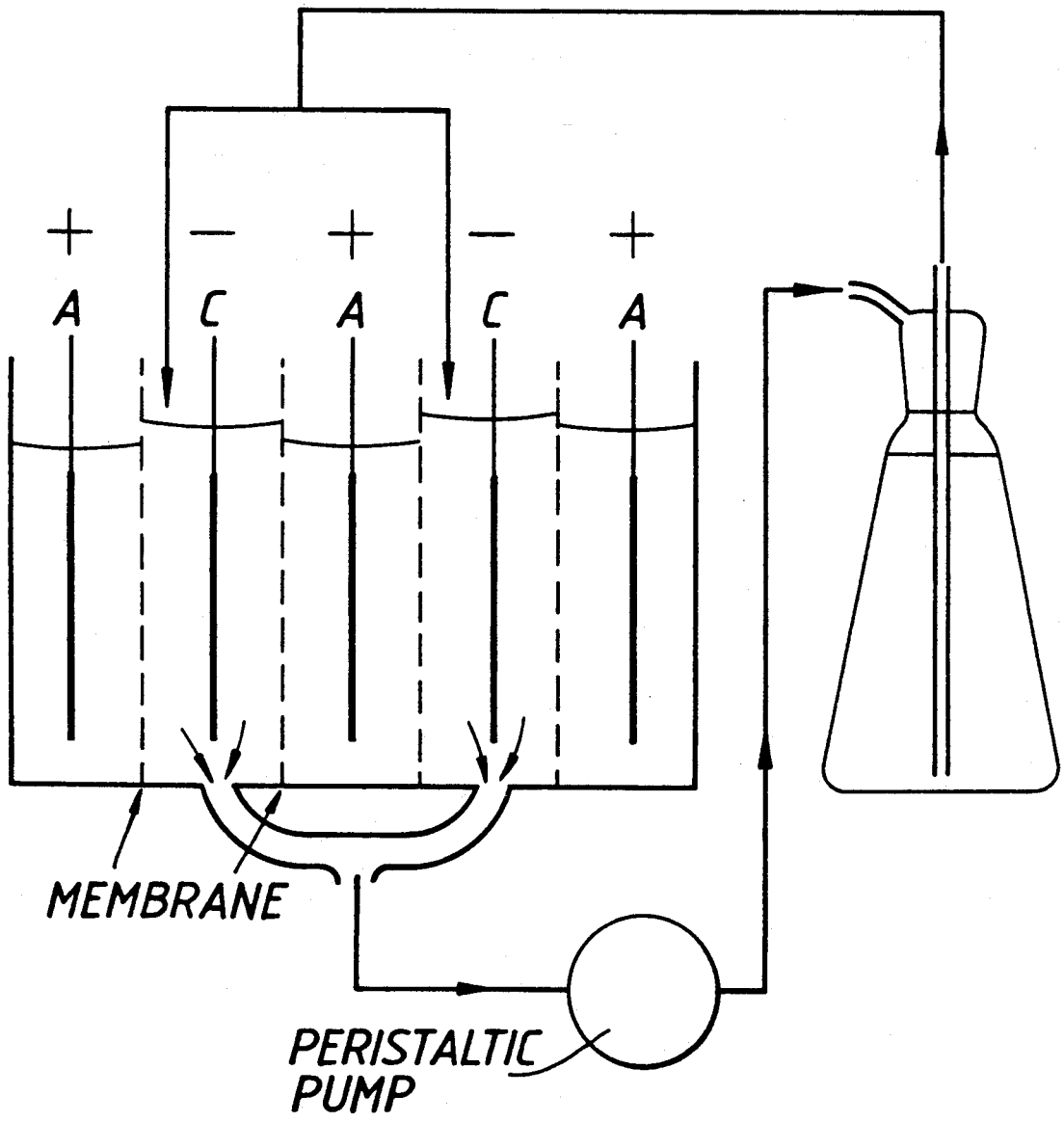
FIG. 8 is a schematic of an electrolytic cell for removal of hydrogen peroxide from the developer-amplifier solution, as described below in Example 3.

Removal of hydrogen peroxide from the developer-amplifier solution by electrolytic reduction at a cathode The electrolytic cell shown in FIG. 8 was constructed. The three anodes and two cathodes were made of perforated stainless steel and were approx. 10 cm by 10 cm. The electrodes were separated by sheets of semipermeable membrane (Gallenkamp PJC-400-070F, Visking, size 5-24/32) and the average electrode separation was 3.0 mm. The 3 anodes were connected together and likewise the 2 cathodes were also connected together. A recirculation system was arranged in the cathode compartments so that a larger quantity (1 liter) of developer than the cell capacity (250 ml) could be treated. The anolyte of the cell was a solution of sodium bicarbonate (16 g/l) and was not recirculated. The following developer-amplifier solution was made up:

| | |
|---|---|
| Sodium sulphite | 1.91 g |
| Sodium carbonate | 14.6 g |
| CD3 | 5.24 g |
| 1-hydroxyethylidene-1,1-diphosphonic acid | 0.825 g |
| Diethyl hydroxylamine | 0.752 g |
| Antifoggant Soln C (Example 1) | 3.04 ml |
| Potassium Chloride | 0.117 g |
| Potassium Bromide | 0.001 g |
| 2N sulphuric acid | 16.7 ml |
| Distilled water | 840 ml |
| Sodium hydroxide | 1.58 g |
| Final volume to | 1000 ml pH 10.2 |

This solution gave the sensitometric parameters shown in Table 1 (below), strip 11 showing the result without amplification. When hydrogen peroxide was added at the rate of 1.29 ml (solution B, Example 1) per 100 ml developer-amplifier solution the amplified image parameters represented by strip 12 were obtained.

To the bulk (1000 ml) of the developer-amplifier solution, 12.9 ml hydrogen peroxide solution was added and the mixture was placed in the reservoir and pumped through the cell. A current of 4 amps (current density 12.5 ma/sq cm) was maintained for 90 mins. During this time the pH increased (pH 12).

Analysis of the solution showed that the hydrogen peroxide had been removed together with some of the following components—diethyl hydroxylamine, sulphite and some colour developing agent. The following additions were made (1 liter developer-amplifier) to compensate for the sensitometric effects of these losses:—Diethyl hydroxylamine 0.37 g, sodium bicarbonate 9.4 g, sodium sulphite 1.53 g, and CD3 1.0 g (representing approx. a 19% loss probably via the membrane). A portion of this readjusted solution was used to process a strip 13 directly and showed no amplification due to the successful removal of the hydrogen peroxide.

On the readdition of the peroxide at the rate indicated above the sensitometric parameters shown by strip 14 were obtained indicating that the amplified sensitometry had been essentially restored (c.f. strips 12 and 14 Table 1).

TABLE 1

| | Inertial Speed | | | Dmin | | | Dmax | | | Contrast | | |
|---|---|---|---|---|---|---|---|---|---|---|---|---|
| Strip Number | Red | Green | Blue | Red | Green | Blue | Red | Green | Blue | Red | Green | Blue |
| 11 (no $H_2O_2$) | 121 | 113 | 116 | 0.096 | 0.118 | 0.099 | 0.640 | 0.730 | 0.736 | 0.827 | 0.932 | 1.028 |
| 12 (+ $H_2O_2$) | 121 | 112 | 121 | 0.122 | 0.132 | 0.110 | 2.636 | 2.650 | 2.337 | 3.673 | 4.426 | 3.530 |
| 13 electrolysed (no $H_2O_2$) (+ additives) | 112 | 107 | 109 | 0.096 | 0.119 | 0.097 | 0.621 | 0.696 | 0.778 | 0.801 | 0.848 | 1.046 |
| 14 electrolysed (+ $H_2O_2$) (+ additives) | 117 | 109 | 117 | 0.126 | 0.136 | 0.113 | 2.711 | 2.687 | 2.445 | 3.996 | 4.796 | 3.857 |

EXAMPLE 4

The removal of hydrogen peroxide from a developer-amplifier solution using a scavenger To 100 ml of the developer-amplifier solution of Example 3 was added 1.29 ml of the hydrogen peroxide solution B, followed by the scavenger 0.25 g of 2,4-dihydroxy-4-methyl-1-piperidinocyclopenten-3-one (sometimes known as piperidino hexose reductone and referred to below as PHR). The solution was shaken to dissolve the compound and then left approx. 60 mins and analysed for $H_2O_2$. A sample of the developer-amplifier solution (without the PHR) was also analysed (1) directly after the addition of the peroxide and also (2) after 60 mins. The results are shown in Table 2. A high proportion of the hydrogen peroxide had been removed by the scavenger.

TABLE 2

| Solution | Age | g/l $H_2O_2$ |
|---|---|---|
| Dev-amp + $H_2O_2$ | Fresh (5') | 1.53 |
| Dev-amp + $H_2O_2$ | (60') | 1.38 |
| Dev-amp + $H_2O_2$ + PHR | (60') | 0.22 |

The effect on the photographic performance of adding the scavenger is shown in Table 3 (below). The sensitometric parameters obtained for strip 15 are without the addition of $H_2O_2$ to the developer-amplifier (i.e. showing no amplification). Strip 16 is the result obtained on the addition of the hydrogen peroxide (i.e. showing normal amplification ). Strip 17 shows the effect on the sensitometry after adding 0.25 g PHR and leaving the solution (occasional shaking) for about 60 mins. before processing. A considerable reduction in amplification is observed due to the scavenging of the hydrogen peroxide. Readdition of hydrogen peroxide to this solution (strip 18) shows that amplification can be reestablished and the result may be compared with strip 16 parameters.

TABLE 3

| | Inertial Speed | | | Dmin | | | Dmax | | | Contrast | | |
|---|---|---|---|---|---|---|---|---|---|---|---|---|
| Strip Number | Red | Green | Blue | Red | Green | Blue | Red | Green | Blue | Red | Green | Blue |
| 15 (no $H_2O_2$) | 137. | 133 | 134 | 0.094 | 0.115 | 0.072 | 0.500 | 0.501 | 0.607 | 0.532 | 0.524 | 0.773 |
| 16 (+ $H_2O_2$) | 137 | 131 | 135 | 0.111 | 0.135 | 0.086 | 2.552 | 2.613 | 2.674 | 2.906 | 3.142 | 3.722 |
| 17 (no $H_2O_2$) (+ PHR) | 138 | 132 | 134 | 0.097 | 0.120 | 0.076 | 0.844 | 1.168 | 1.796 | 0.904 | 1.356 | 2.099 |

TABLE 3-continued

| | Inertial Speed | | | Dmin | | | Dmax | | | Contrast | | |
|---|---|---|---|---|---|---|---|---|---|---|---|---|
| Strip Number | Red | Green | Blue | Red | Green | Blue | Red | Green | Blue | Red | Green | Blue |
| 18 (+ $H_2O_2$) | 139 | 132 | 143 | 0.109 | 0.131 | 0.085 | 2.501 | 2.693 | 2.687 | 2.853 | 3.575 | 3.519 |

EXAMPLE 5

A developer-amplifier of the composition shown below was made up and an initial sample taken for analysis. Solid sodium metabisulphite (5 g/l) was added with vigorous stirring. Samples were taken and analysed by iodine/thiosulphate titration for hydrogen peroxide content.

| Dev-amp composition | |
|---|---|
| Potassium carbonate | 20.0 g/l |
| EDTA ($Na_2$) | 0.1 g/l |
| Diethylhydroxylamine | 2.0 ml/l |
| CD3 | 8.0 g/l |
| Hydrogen peroxide (30%) | 5.0 ml/l |

The hydrogen peroxide level after the addition of sodium metabisulphite was found to be as follows:

| TIME (min) | $H_2O_2$ (ml/l, 30%) |
|---|---|
| 0 | 4.7 |
| 0.5 | 1.9 |
| 1.0 | 0.8 |
| 2.0 | 0.0 |

After two minutes all the hydrogen peroxide had reacted. The absence of hydrogen peroxide was confirmed in a separate experiment by the addition of manganese dioxide before and after sulphite addition. Manganese dioxide decomposes hydrogen peroxide with the visible evolution of oxygen. This ceased completely 2 minutes after adding metabisulphite.

5 ml/l of 30% hydrogen peroxide is equivalent to 0.044 M and 5 g/l of sodium metabisulphite is equivalent to 0.056 M sulphite ion. A slight excess of total sulphite ion appears to be necessary for complete removal of peroxide.

Figure 9:
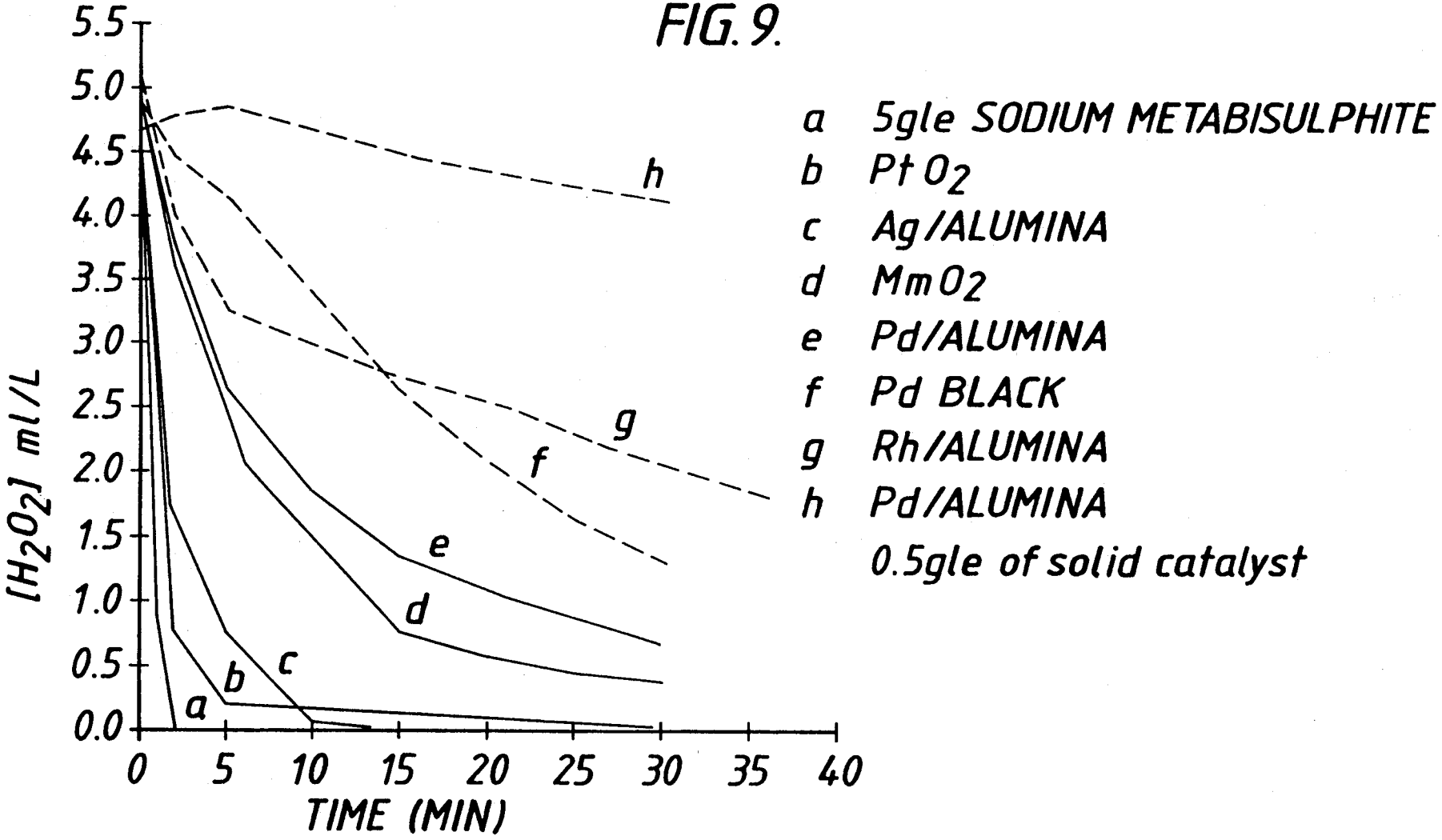
FIG. 9 is a plot of hydrogen peroxide concentration against time for several metal and metal oxide catalysts examined for peroxide removal, as described below in Example 5.

As a comparison several metal and metal oxide catalysts (at 0.5 g/l) were examined for peroxide removal and a plot of hydrogen peroxide against time for these is shown in FIG. 9, with metabilsulphite on the same plot.

EXAMPLE 6

Figure 10:
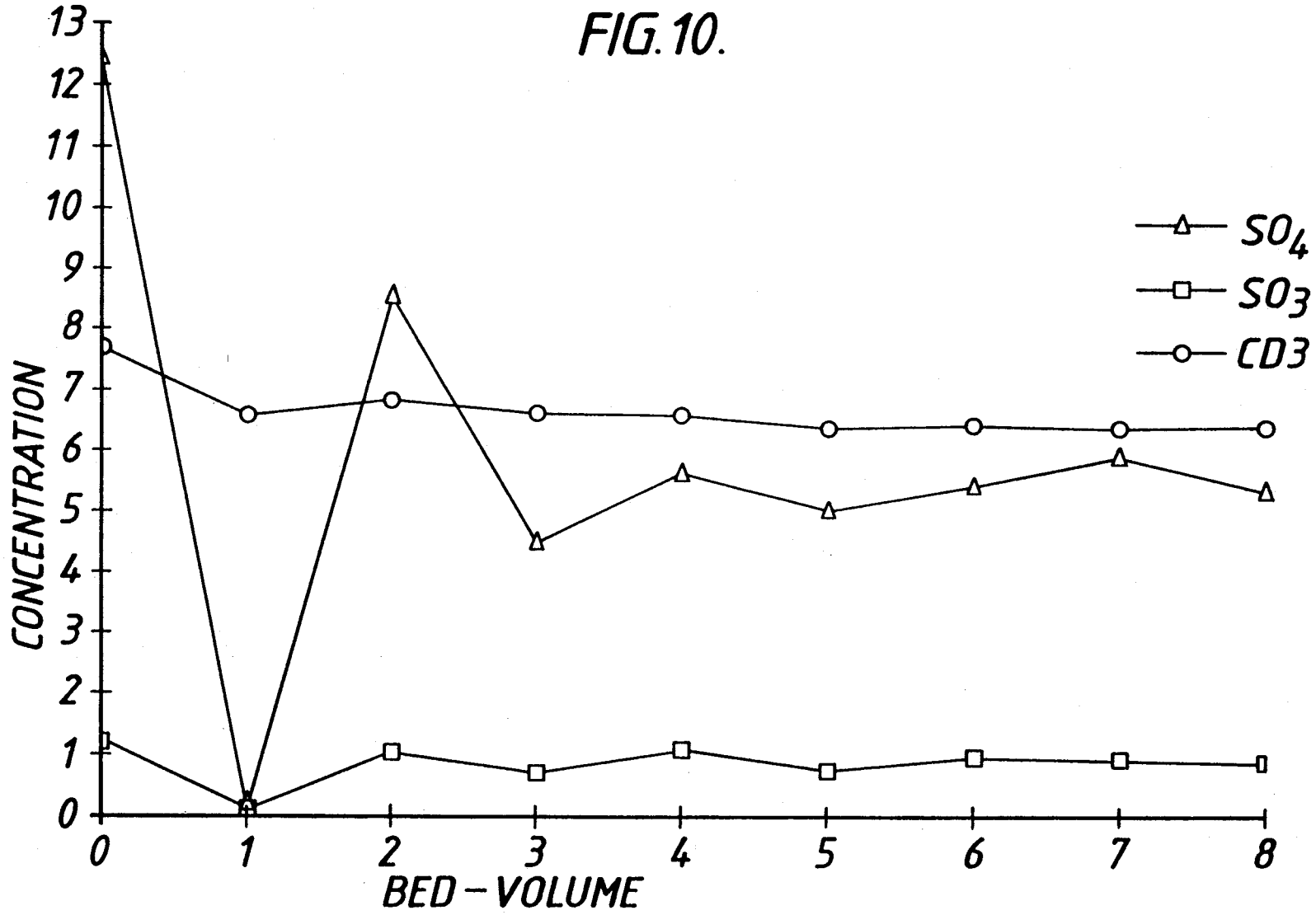
FIG. 10 is a plot of sulphate, sulphite, and CD3 versus ion exchange column bed-volume, as described in detail in Example 6, below.

A variant of Example 5 was performed in which 6 g/l sodium metal)isulphite was added to the dev-amp solution and after 5 minutes the solution was passed through an ion-echange column (IRA 400) in order to remove excess sulphite and sulphate. It can be seen in FIG. 10 that both sulphite and sulphate are completely removed in the first bed colume but only partially removed subsequently. CD3 was lowered slightly in the first bed volume but then remained constant.

Another version of this procedure was carried out in which the ion-exchange column was regenerated using potassium sulphite and then washed. The dev-amp solution was then passed through the column to effect peroxide removal. Peroxide was effectively removed on passage through the column lbut sulphite was displaced from the column and went into solution.

EXAMPLE 7

Bisulphite ion forms an addition complex with formaldehyde and other aldehydes and these are used in some black and white developer solutions as a controlled source of low levels of sulphite. The addition of sodium formaldehyde-bisulphite (1 g/l) to the dev-amp did remove peroxide but at a fairly slow rate as shown in the table below.

| TIME (min) | $H_2O_2$ (ml/l, 30%) |
|---|---|
| 0 | 5.10 |
| 2.5 | 4.40 |
| 5.5 | 4.09 |
| 10.25 | 3.95 |
| 15.25 | 3.78 |
| 20 | 3.55 |
| 25 | 3.43 |
| 30 | 3.30 |

The amount of sodium formaldehyde bisulphite at 1 g/l is probably too low to completely remove the hydrogen peroxide although it was observed that formaldehyde itself also reacts with peroxide which provides some additional capacity.

EXAMPLE 8

Sodium glutaraldehyde bisulphite reacts much faster than the formaldehyde compound as shown in the table below.

| TIME (min) | $H_2O_2$ (ml/l, 30%) |
|---|---|
| 0 | 4.97 |
| 2 | 1.93 |
| 5 | 0.45 |
| 10 | 0.22 |

The dev-amp solution became very dark during this time as if the colour developing agent was being oxidised. The solution, however, was not analysed for CD3 content which might have confirmed this.

We claim:

1. A method of forming a dye image in a photographic silver halide element containing a dye-providing compound and having in a layer thereof an imagewise distribution of catalytic silver which comprises the step of treating the material with a redox amplifying solution comprising a reducing agent and a redox amplification oxidant characterised in that the redox amplification oxidant is removed from the solution after use and the so-treated solution is re-used after the addition of fresh redox amplification oxidant.

2. A method as claimed in claim 1 in which the dye-providing compound is a colour coupler.

3. A method as claimed in claim 1 in which the reducing agent is a colour developing agent.

4. A method as claimed in any of claim 1 in which the oxidant is hydrogen peroxide.

5. A method as claimed in claim 1 in which the oxidant is removed continuously or intermittently.

6. A method as claimed in claim 5 in which the oxidant is removed when processing is not taking place.

7. A method as claimed claim 4 in which the hydrogen peroxide is removed by decomposing it by contact with a catalyst for the decomposition of hydrogen peroxide.

8. A method as claimed in claim 4 in which the hydrogen peroxide is removed by dialysis through a semipermeable membrane.

9. A method as claimed in claim 4 in which the hydrogen peroxide is removed by treatment with a hydrogen peroxide scavenger.

10. A method as claimed in claim 9 in which the hydrogen peroxide scavenger is a water soluble sulphite or metabisulphite.

11. A method as claimed in claim 4 in which the hydrogen peroxide is removed by electrolysis with or without a semipermeable or anionic membrane.

12. A method as claimed in claim 1 in which the material is a multicolour photographic material comprising a support bearing a yellow dye image-forming unit comprised of at least one blue-sensitive silver halide emulsion layer having associated therewith at least one yellow dye-forming coupler, and magenta and cyan dye image-forming units comprising at least one green- or red-sensitive silver halide emulsion layer having associated therewith at least one magenta or cyan dye-forming coupler respectively.

* * * * *